US006387583B1

(12) United States Patent
Yoon

(10) Patent No.: US 6,387,583 B1
(45) **Date of Patent: *May 14, 2002**

(54) METHOD OF PRODUCING TONER FOR DEVELOPING LATENT ELECTROSTATIC IMAGES BY WAY OF DISPERSION DYEING

(75) Inventor: Hyun-Nam Yoon, Towaco, NJ (US)

(73) Assignee: MatSci Solutions, Inc., Towaco, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/457,543

(22) Filed: Dec. 9, 1999

(51) Int. Cl.[7] ..... G03G 9/08
(52) U.S. Cl. ..... 430/137.16; 430/137.1
(58) Field of Search ..... 430/137, 106, 430/109, 137.16, 137.1, 109.4

(56) References Cited

U.S. PATENT DOCUMENTS

| | | | | |
|---|---|---|---|---|
| 2,297,691 A | | 10/1942 | Carlson | |
| 4,645,727 A | | 2/1987 | Ong et al. | 430/106 |
| 4,778,742 A | | 10/1988 | Ong et al. | 430/106 |
| 4,880,432 A | * | 11/1989 | Egan et al. | 430/115 |
| 5,102,761 A | | 4/1992 | Ohsaki et al. | 430/106 |
| 5,200,290 A | | 4/1993 | Ong et al. | 430/115 |
| 5,212,033 A | | 5/1993 | Tsubota et al. | 430/106 |
| 5,296,325 A | | 3/1994 | Ohtsuka et al. | 430/106 |
| 5,352,521 A | | 10/1994 | Hotta et al. | 428/402 |
| 5,437,953 A | | 8/1995 | Russell et al. | 430/106 |
| 5,470,687 A | | 11/1995 | Mayama et al. | 430/137 |
| 5,500,321 A | | 3/1996 | Kasuya et al. | 430/109 |
| 5,565,298 A | | 10/1996 | Suguro et al. | 430/137 |
| 5,693,444 A | | 12/1997 | Takagi et al. | 430/106.6 |
| 6,001,524 A | * | 12/1999 | Yoon | 430/137 |

FOREIGN PATENT DOCUMENTS

| | | | | |
|---|---|---|---|---|
| GB | 1373531 | | 11/1974 | C08G/20/20 |
| JP | 3-121466 | * | 5/1991 | |
| JP | 5-134458 | * | 5/1993 | |

OTHER PUBLICATIONS

Chemical Abstract Registry No. 17418–58–5, 31810–89–6, & 6439–53–8, 2000.*
Alger, Mark S.M. Polymer Science Dictionary. London: Elsevier Applied Science. pp. 361 & 385, 1989.*
Aldrich Handbook of Fine Chemicals and Laboratory Equipment 2000–2001. Milwaukee. pp. 1372, 2000.*
Powder Technology Handook, 2nd edition, Marcell Dekker PUblications (1997), pp. 3–13, K. Gotoh et al.

* cited by examiner

*Primary Examiner*—Christopher Rodee
(74) *Attorney, Agent, or Firm*—Michael W. Ferrell

(57) ABSTRACT

A process for preparing a dispersion dyed color toner for developing latent electrostatic images includes dyeing a particulate polymer resin in organic medium in which the resin is not soluble. The resin is a functionalized resin having sites suitable for interacting with functionalized dyes have corresponding functionality. The functionalized dye is applied to the resin particles typically with a dyeing aid, or surfactant. The particle size distribution of the polymer resin is substantially unchanged during the toner preparation process.

15 Claims, No Drawings

METHOD OF PRODUCING TONER FOR DEVELOPING LATENT ELECTROSTATIC IMAGES BY WAY OF DISPERSION DYEING

BACKGROUND OF THE INVENTION

The formation and development of images on the surface of photoconductive materials by electrostatic means is well known. The basic electrophotographic imaging process (U.S. Pat. No. 2,297,691) involves placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic toner material. The toner will normally be attracted to those areas of the photoreceptor which retain a charge, thereby forming a toner image corresponding to the electrostatic latent image. This developed image may then be transferred to a substrate such as paper. The transferred image subsequently may be permanently affixed to the substrate by heat, pressure, a combination of heat and pressure, or other suitable fixing means such as solvent or overcoating treatment.

Toners and developer compositions including colored particles are well known. Some U.S. patents in this regard are U.S. Pat. Nos. 5,352,521, 4,778,742, 5,470,687, 5,500,321, 5,102,761, 4,645,727, 5,437,953, 5,296,325 and 5,200,290. The traditional compositions normally contain toner particles consisting of resin and colorants, wax or a polyolefin, charge control agents, flow agents and other additives. A typical toner formulation generally contains about 90–95 weight percent resin, about 2–10 weight percent colorant, 0-about 6 weight percent wax, 0-about 3 weight percent charge control agent, about 0.25–1 weight percent flow agent and 0-about 1 weight percent other additives. Major resins are styrene-acrylic copolymers, styrene-butadiene copolymers and polyesters. The colorants usually are selected from cyan dyes or pigments, magenta dyes or pigments, yellow dyes or pigments, and mixtures thereof.

One of the main advantages of selecting organic dyes instead of pigments for color toner compositions resides in the provisions of increased color fidelity as the dyes can be molecularly dispersed in the toner resins. To obtain a homogeneous dispersion, it is generally necessary to build into these molecules certain substituents for enhancing their compatibility with the toner resin. Unless the dye molecules are substantially fully compatible with the toner resins, they have a tendency to aggregate with time, especially when subjected to heat, pressure and humidity thereby resulting in a loss of color fidelity. Additionally, the low molecular weight of the dye molecules causes a high lability or mobility of the dye molecules in the toner resin resulting in undesirable bleeding of the dyes.

An attempt for improvement is to incorporate a dye into preformed resin particles by dispersing the particles in a dye solution and diffusing the dye into the central portion of each resin particle. For example, U.S. Pat. No. 5,565,298 discloses a method of producing toner particles comprising of a copolymer of styrene and n-butylmethacrylate formed by a suspension polymerization method and dyed by dispersing in a bath comprising of a dye and methanol as solvent. However, the method has several deficiencies that make it unsuitable for producing high-resolution toner particles. The dyeing has to be carried out below the glass transition temperature of the resin and it therefore takes a long dyeing time. Particles also tend to coagulate in the course of dyeing resulting in a large average particle size and a broad size distribution. Incorporating a sufficient amount of dyes for vivid color image is difficult due to a limited solubility of dyes in polymer resins. Dyes tend to migrate out of the particle during storage and evaporate during the fixing stage of electrophotography process, severely interfering with operation of electrophotography equipment.

There is continuing interest in the development of new and improved methods of producing toners for application in high-resolution color electrophotography. Accordingly, an object of the present invention is to provide a method of producing high-resolution color toner which has a superior combination of properties for electrophotographic imaging systems by dispersing resin particles and a dye in a bath and effecting the dye molecules to be absorbed in the central portion of each resin particle while substantially maintaining the size and size distribution of the resin particles.

Other objects and advantages of the present invention shall become apparent from the accompanying description and examples.

SUMMARY OF INVENTION

There is provided in accordance with the present invention a process of preparing a toner for developing latent electrostatic images comprising: dispersing a particulate polymer resin with functional sites suitable for interacting with a functionalized dye in a liquid organic medium; the polymer being substantially insoluble in the organic medium; providing a functionalized dye to the organic medium wherein the functionalized dye has functional sites adapted for interacting with the functional sites on the particulate polymer resin; maintaining the organic medium containing the particulate resin at an elevated temperature for a time sufficient to dye the resin and separating the organic medium from the particulate polymer resin. The functionalized dye is thus applied to the resin particles and the particle size of the particulate polymer resin is substantially unchanged during the dyeing process recited above.

The particulate polymer resin is most preferably a polyester resin. The polyester resin may have functional sites suitable for interacting with a functionalized dye selected from the group consisting of: hydroxyl moieties; alkoxyl moieties; sulfonic or derivatized sulfonic moieties; sulfonic or derivatized sulfonic moieties; carboxyl or derivatized carboxyl moieties; phosphonic or derivatized phosphonic moieties; phosphinic or derivatized phosphinic moieties; thiol moieties, amine moieties; alkyl amine moieties; quaternized amine moieties; and mixtures thereof. In typical embodiments the particulate polymer resin has a volume average particle size of from about 1 to about 15 microns. Generally at least about 80 weight percent of the particles of the particular polymer resin are within from about 0.5 to about 1.5 times the volume average particle size of the particulate polymer resin. In other embodiments the particulate polymer resin has a volume average particle size from about 2 to about 10 microns and sometimes from about 2 to about 4 microns while an average particle size of from about 5 to about 8 microns is preferred in some embodiments.

In some cases the polyester resin is prepared by way of dispersion polymerization.

Any suitable dye may be used in the practice of the present invention so long as it can be bound to the particulate polymer resin. Preferred dyes include basic dyes, acid dyes, or reactive dyes. The weight ratio to dye to particulate polymer resin is generally from about 1:100 to about 10:100 or from about 1 to about 10 percent by weight.

The solubility parameter value of the organic medium is smaller than the solubility parameter value of the particulate polymer resin by at least about 1. More preferably the solubility parameter of the organic medium is smaller than the solubility parameter value of the particulate polymer resin by at least about 2. Particularly preferred are paraffin containing organic media.

A dyeing aid, typically a surfactant, is preferably included in the inventive process. Most preferred are non-ionic surfactants as detailed further herein. Especially useful non-ionic surfactants include the residue of an ethylene oxide moiety or a propylene oxide moiety.

The surfactant may be present in an amount of from about 0.2 to about 2 times the amount of non-polar solvent present in the organic medium, that is from about 5 to about 200 percent by weight of the non-polar solvent, whereas from about 10 to about 50 percent is more typical with from about 20 to about 40 weight percent of surfactant being preferred.

It is likewise preferred to operate the inventive process at relatively high solids content wherein the polymer resin is present in an amount of from about 10 to about 70 volume percent of the combined volume of resin and organic medium during dying. From about 20 to about 40 volume percent resin is perhaps more typical in some embodiments.

The elevated temperature at which the process of the invention is carried out is generally greater than 20° C. less than the glass transition temperature of the resin being dyed. For example, a resin having a glass transition temperature of 100° is dyed at a temperature greater than about 80° C. During the dyeing process the organic medium is maintained at an elevated temperature which is typically higher than the glass transition temperature of the particulate polymer resin so that the dye and the charge control agent can readily penetrate the resin. Particularly preferred in some embodiments is an elevated temperature of at least about 30° C. higher than the glass transition temperature of the polymer resin. Typically the polymer is dyed for at least five minutes and in many embodiments between about 5 and about 60 minutes.

A charge control agent is preferably added during the step of dyeing the particulate resin so as to simplify processing.

There is provided in another aspect of the present invention a dispersion dyed color toner for developing latent electrostatic images. The inventive toner is prepared by a process including dispersing a particulate polymer resin provided with functional sites suitable for interacting with a functionalized dye in a liquid organic medium, the polymer being substantially insoluble in the organic medium; providing the functionalized dye to the organic medium, wherein the functionalized dye has functional sites adapted for interacting with the functional sites on the particulate polymer resin; maintaining the organic medium, containing the particulate polymer resin and the dye at an elevated temperature for a time sufficient to dye the resin; and separating the organic medium from the particulate polymer resin. The functionalized dye is thus applied to the resin particles and the particle size of the particulate polymer resin is substantially unchanged during the process of preparing the toner.

In most embodiments the color toner also includes a charge control agent present in an amount from about 0.1 weight percent to about 10 percent by weight of the toner. The toner may optionally include a flow improvement agent such as fumed silica.

There is provided in still yet another aspect of the present invention a developer composition comprising the dispersion dyed color toner of the present invention. The developer composition includes the toner and carrier particles selected from the group consisting of ferrite particles, steel powder, iron powder and the like having a surface active agent coated therein. Examples of the carrier composition are described in U.S. Pat. No. 5,693,444.

DETAILED DESCRIPTION OF THE PREFERRED EMBODIMENTS

As the resins for preparing toner particles for thermal image fixing, the conventionally known resins such copolymers of styrene and acrylate and polyesters. Polyesters are preferred for color toner applications because of their superior compatibility with colorants and adhesion to various printing substrates.

Furthermore, the resins, suitable for the inventive process, are chemically modified to contain one or more reactive functionalities in about 1–10 mole percent amounts. The reactive functionalities are chosen as to be reactive toward suitable dyeing reagents either by a covalent bonding or by ionic complexing mechanism. Examples of the functional groups include, but are not limited to, the moieties hydroxyl, alkoxy, sulfonic or derivatized sulfonic, sulfinic or derivatized sulfinic, carboxyl or derivatized carboxyl, phosphonic or derivatized phosphonic, phosphinic or derivatized phosphinic, thiol, amine, alkylamine and quaternized amine and combinations thereof, e.g., $—S0_3M$, O—COOM, $—P(=O)(OM)_2$, $—P(=O)R(OM)$, —OH, —OR, $—NR_1R_2R_3N$, —NHR and —SH, where R, $R_1$, $R_2$ and $R_3$ are alkyl groups, M is a metal group and N is an anion.

In the present invention, it is preferable to use small resin particles which have a volume average particle size (L) in the range 1–15 $\mu$m. The terms "volume average particle size" is defined in, for example, Powder Technology Handbook, 2nd edition, by K. Gotoh et al, Marcell Dekker Publications (1997), pages 3–13. More specifically, it is preferable to use resin particles which include resin particles with a particle size distribution in the range of 0.5 ×L to 1.5 ×L in an amount of 80 wt. % or more of the entire weight of the resin particles. This is because the resin particles with such a narrow particle size distribution provide toner particles which are uniformly dyed, have uniform quantity of electric charge in each toner particle, and can provide high-quality copy images and for which charge control is easy in a development unit.

In the present invention, the particle size distribution is measured by a commercially available Coulter LS Particle Size Analyzer (made by Coulter Electronics Co., Ltd., St. Petersburg, Fla.).

The desired polyesters of suitable particle shape and size may be prepared from the above-noted components by a variety of techniques. In order to prepare resin particles with the above-mentioned mean particle size and narrow particle size distribution, a dispersion polymerization method, in particular, the dispersion Ad polymerization method disclosed in British Patent 1,373,531, is suitable. The disclosure of the '531 patent is incorporated herein by reference. Generally in a typical dispersion process, polymerizable monomers, an initiator and a dispersion stabilizer are dispersed in a solvent which is immiscible with the monomers. Under a vigorous shearing action, the monomers are finely dispersed as small droplets in the solvent and the droplets are stabilized without coalescence by the presence of the stabilizer molecules on their surface. The dispersion is then heated to an initiation temperature and the polymerization proceeds in each droplet. After a specified polymerization period, the reaction mixture is cooled to ambient temperature and polymer particles are separated by filtration for further processing. In the process, the particle size is controlled by the amount of added stabilizer and the shearing. The molecular weight of the polymer is controlled by the initiator amount and/or the polymerization time.

Optionally, the resin particles may be prepared by a milling process commonly used in preparing conventional toners and described, for example, in U.S. Pat. No. 5,102,761. In that process, a polyester resin is mechanically crushed, milled into small particles and then classified to obtain particles with desired particle size and size distribution.

The advantage of these resin particles is that they can be directly dyed by appropriately reacting the functionalities on the polymer with appropriate coloring reagents. The coloring reagent is typically a dye which may be a basic dye, acid dye, reactive dye and combinations thereof. Basic dyes are cationic molecules which ionically bind to anionic sites. Acid dyes are anionic molecules which bind to cationic or basic sites, while reactive dyes are functional molecules which contain groups that covalently bind to sites such as, for example, —OH, —SH or —NRH in order to form respectively an ether, thioether or amine linkages.

The weight ratio of the dye to the resin to be dyed can be selected as desired, depending upon the desired color tone. However, generally it is preferable that the amount of the dye is in the range of 1 to 10 parts by weight to 100 parts by weight of the resin particles to be dyed.

It is preferable to employ a solvent in which the resin particles are not soluble. More specifically, it is preferable that the solubility parameter value of the solvents is smaller than that of the resin particles by 1.0 or more, more preferably 2.0 or more. For example, it is preferable to employ a non-polar organic solvent having a low solubility parameter value such as paraffins, paraffinic esters, paraffinic amides and paraffinic ethers in combination with the styrene-acrylic resin particles or the polyester resin particles. In contrast, when a highly polar solvent such as water, methanol, propanol, and acetone is employed as a solvent for the dyeing process, significant coalescence of the particles occurs.

Particularly preferred organic media for use in connection with the invention are paraffins. Examples of paraffins are normal and isoparaffins with 7 or more carbon atoms such as: octane, decane, dodecane, and isoparaffinic mixtures sold under the name "Isopar®" by Exxon Chemical Company, Houston, Tex. Grades and their carbon numbers are as follows: Isopar® C C7-8; Isopar® E, C8-9; Isopar® G C10-11; Isopar® H C11-12; Isopar® K C1-12; Isopar® L C11-13; Isopar® M C13-14; and Isopar® V C12-40. These Isopar® are manufactured by distillation and each designation refers to the take off positions of a distillation column. Also suitable for organic media to be utilized in the dyeing process of the present invention are mineral oils which are mixtures of paraffins. So also paraffinic esters such as dodecyl acetate may be employed; whereas paraffinic amides such as decylamine may also be employed.

A surfactant is used in conjunction with the aforementioned non-polar solvent in the dyeing operation of this invention. The surfactant performs two important functions for successful dyeing of the particles. First, it prevents coalescence of the resin particles during the dyeing reaction. In the inventive process, dyeing is carried out generally at a temperature higher than the glass transition temperature of resin. Thus, in the absence of the surfactant, the particles are in the molten state, tend to coalesce in an uncontrollable manner and produce dyed particles which are unsuitable as a high-resolution toner. Secondly, the functional dyes employed in the present invention are generally insoluble in non-polar solvents and a means of delivering the dye molecules to the resin particles does not exist in the absence of the surfactant. The surfactant, having polar sites in its molecular structure and thus some solubility of the dye, plays the important role of transporting dye molecules from the dye particles to the resin particles and thus enabling the dyeing without a substantial particle agglomeration even when the amount of the resin to the solvent is as high as 100 parts by weight to 100 parts by weight of the total liquid medium in dye bath. The surfactant may be anionic, cationic or non-ionic. It is preferable that the surfactant is non-ionic.

The weight ratio of the surfactant to the non-polar solvent can be selected as desired depending on the amount of the resin particle to be dyed and the required processing time. However, generally it is preferable that the amount of the surfactant is in the range of 5 to 200 parts by weight to 100 parts by weight of the non-polar solvent. From about 10 to about 40 percent by weight of surfactant is somewhat typical, based on the weight of solution. The amount of the total liquid medium in dye bath to the resin to be dyed can be selected as desired. However, generally it is preferable that the amount of the solvent is in the range of 50 to 1000 parts by weight to 100 parts by weight of the resin particles to be dyed.

Examples of useful classes of non-ionic surfactants include alkylphenol ethoxylates, aliphatic alcohol ethoxylates, fatty acid alkoxylates, fatty alcohol alkoxylates, block copolymers of ethylene oxide and propylene oxide, condensation products of ethylene oxide with the product resulting from the reaction of propylene oxide and ethylenediamine and condensation products of propylene oxide with product of the reaction of ethylene oxide and ethylenediamine. Particularly useful surfactants include the reaction product of a fatty acid or a fatty alcohol with ethylene oxide such as a polyethylene glycol diester of a fatty acid (PEG diols or PEG diesters). A particularly preferred surfactant for use in the connection with the present invention includes Genapol®-26-L-1 surfactant available from Clariant Corporation which has the chemical structure of $C_{13}H_{27}—C_6H_4—(—CH_2—CH_2O—)—CH_2—CH_2—OH$.

In the present invention, the dyeing is carried out, for example, by dispersing an appropriate functional dye in the above-mentioned mixture of a non-polar solvent and a surfactant, then dispersing the resin particles in the bath and stirring the dispersion under the conditions that the temperature of the dispersion is kept at a temperature of about 30° C. or higher than the glass transition temperature of the resin. The high temperature ensures the penetrating rate of the dye into the resin particles to be sufficiently high that dyed resin particles can be obtained in about 5 minutes to about 60 minutes. For agitating the dispersion of the dye and resin particles, a conventional stirrer such as a blade-type mixer or a magnetic stirrer can be employed.

In the above-mentioned processes, dyed slurry is obtained. Dyed resin particles can be obtained from the slurry by any conventional methods. For example, dyed resin particles are separated from the slurry by filtration. The non-solvent and the surfactant are entrained in the filter cake and they are washed with a hydrocarbon with a low boiling temperature such as n-pentane, n-hexane, iso-hexane and the like. It is important not to use a polar organic solvent such as methanol, propanol or isobutanol for the washing since the cake tends to agglomerate upon exposure to such a solvent. The washed particles are then dried at a temperature below the glass transition temperature of the resin, or under reduced pressure. The thus obtained toner particles have substantially the same particle size distribution as that of the original resin particles.

In the present invention, in order to improve the triboelectric charging characteristics of the toner, charge control agents ("CCA") which are conventionally known in this field can be contained in the toner particles. Suitable charge control agents may be the negative-type or the positive-type. Several such CCAs are commercially available such as, for example, the Bontron® E-88 brand CCA (a negative charge control agent which is an aluminum compound, available from Orient Chemical Corporation, Springfield, N.J.) and the Bontron® P-53 brand CCA (a positive CCA, also available from Orient Chemical Corporation). Such processes as dry mixing, solvent coating, spray coating and like may be used.

In the inventive process, a CCA is dissolved in an organic solvent mixture, specially prepared to prevent agglomeration of the dyed resin particles during CCA application, and either the dyed resin particles are immersed in the CCA solution at an elevated temperature conducive for diffusing-in of the CCA into the central portion of the particles or the solution is sprayed onto the dyed particles. Subsequently, the organic solvent is removed by drying, whereby the CCA is caused to stay in the central portion of the toner particles or on the surface of the toner particles, respectively. It is preferable that the solvent mixture used for the CCA application is the same solvent mixture used in the aforementioned dyeing process.

As another method of incorporating the charge control agent in the toner particles, a mechanical deposition method can be employed, in which a CCA, preferably with a particle size of 1 $\mu$m or less, is mechanically fixed to the surface of the toner particles by causing the CCA particles to collide with the toner particles with application of mechanical energy thereto, when necessary, under application of thermal energy, whereby the CCA is fixed to the surface of the toner particles to such a fixing degree that the CCA does not come off the toner particles while in use.

For this mechanical deposition method, for example, a mixing apparatus such as ball mill, V-blender, or Henshel Mixer, is employed for mixing the CCA and the toner particles. Mechanical energy is then applied to this mixture, for instance, by rotating the mixture with rotary blades which are rotated at high speed, or by causing the CCA particles to collide with the toner particles within a stream of air which flows at high speed, or by causing both particles to collide with a collision plate in such an air stream, whereby the CCA is firmly fixed to the surface of the toner particles.

As commercially available apparatus for the above purpose of applying such mechanical energy, for instance, an apparatus named Mechanofusion® (made by Hosokawa Micron Co., Ltd., Summit, N.J.), a crushing mill which is modified so as to reduce crushing air pressure as compared with that of an ordinary crushing mill.

In the present invention, it is preferable that the amount of the CCA is 0.1 to 10 parts by weight to 100 parts by weight of the dyed resin particles for appropriately controlling the triboelectric charging characteristics of the toner particles and image fixing performance, although the above ratio can be varied, depending upon the charge quantity required for the toner particles or a development means for use with the toner particles.

The CCA-containing particles may then be coated with a suitable flowability improvement agent. They generally help to enhance the flowability of the particles during their use as color toner. Suitable flow agents are materials such as finely-divided particles of hydrophobic silica, titanium oxide, zinc stearate, magnesium stearate and the like which may be applied by processes such as, for example, dry mixing, solvent mixing and the like. In a typical process, a hydrophobic fumed silica (previously treated with a surface activating reagent such as, for example, hexamethyldisilazane and available under the trade name Cab-O-Sil® T-530 from Cabot Corporation, Tuscola, Ill.) is mixed with the CCA-coated particles and blended well in a tumble mixer for about 10–60 minutes to obtain flow agent-coated toner particles.

In many color toner applications, the toner particles are used as a developer which typically contains the dyed particles as described above (containing the CCA and the flow agent) and a suitable carrier agent (such as, for example, ferrites, steel, iron powder and the like, optionally containing a surface treating coating agent thereon) are mixed together intimately to form the developer.

The features of the present invention will become apparent in the course of the following description of examples, which are given for illustration of the invention and are not intended to be limiting thereof.

EXAMPLES

Example 1

Preparation of a Cationically Dyeable Polyester Resin

A cationically dyeable polyester is prepared by a melt condensation process. Into a 10-liter glass reaction vessel fitted with a paddle stirrer and a 20 cm fractionating column, dimethyl fumarate (4.85 moles, 693 gr), sodium salt of dimethyl 5-sulfoisophthalate (0.15 moles, 44.4 g), and bisphenol A propoxylate (5 moles, 1720 g) are charged. Titanium tetra-isopropoxide (0.7 gr) is used as the ester exchange catalyst and 2.5 gr of IRGANOX 1010 (available from Clariant Corporation, East Hanover, N.J.). The reactants are charged at ambient temperature and are purged with argon gas for about 1 hour. The reactant mixture is then heated to 150° C. with the stirrer on at 50 rpm to form a homogeneous melt. Subsequently, the reaction mixture is heated from 150° C. to 200° C. under a flowing argon atmosphere over 4 hours and maintained at 200° C. until approximately 170 ml of distillate is collected.

The reaction mixture is then slowly heated to 210° C. in about 30 minutes and is maintained at the temperature for one hour while under agitation of 50 rpm. The agitator speed is then lowered to 30 rpm and the reactor is put under a vacuum of 0.5 torr for one hour. Subsequently, the vacuum is released with argon and the reactant cooled downed to about 150° C. The content of the reactor is poured onto a glass plate and allowed to cool down to ambient temperature. Approximately 1800 gr of polymer is obtained.

The glass transition of the thus prepared polyester is 54° C. The glass transition temperature is measured by use of a commercially available differential scanning calorimeter (DSC) apparatus (910 Differential Scanning Calorimeter available from E. I. DuPont Corporation, Wilmington, Del.). The number average molecular weight of the polyester is 3250 and the weight average molecular weight 11200, producing a polydispersity of 3.5. The molecular weights are determined by gel permeation chromatography (GPC) using tetrahydrofuran as solvent, polystyrene as molecular weight standard with a GPC apparatus and columns (Alliance® GPC 2000 System and Styragel® GPC Columns available from Waters Corporation, Milford, Mass.).

Example 2

Milled Particles of the Melt-polymerized Polyester 1000 g of the polyester resin of Example 1 is pulverized and further milled using a ball mill. The resulting particles are then manually classified using a series of sieves to collect polyester particles in the size range of 5 microns to 15 microns. The particle larger than 15 microns are recycled into the ball mill and the particles smaller than 5 microns are discarded. This process is repeated until the collect particle reaches an amount of approximately 300 gr. The volume average particle size is 10.8 microns with a 10% size of 5 microns and a 90% size of 14.5 microns as measured by a Coulter® LS Particle Size Analyzer. Scanning electron microscopy shows that the particles are jagged and irregular.

Example 3

Cyan Toner from the Milled Polyester Particles

Into a 250-ml round-bottom flask equipped with a blade-type agitator, 72 g of Isopar-L®, 12 g of Genapol® 26-L-1 and 48 g of the milled particles of Example 2 are charged. The mixture is then heated to 90° C. and maintained at the temperature for 30 minutes under agitation at 100 rpm. 0.56 g of Astrazon® Blue BG 200 (a CI Basic Blue 3 dye available from DyStar L.P., Charlotte, N.C.) is added to the reaction mixture. The dyeing reaction mixture is maintained at the temperature for 60 minutes.

Subsequently, 0.72 g of Bontron® E-84 (a negative charging charge control agent based on a zinc salt available from Orient Chemical Corporation of America, Springfield, N.J.) is added into the dyeing reaction mixture. The reaction mixture is maintained at 90° C. for additional 30 minutes to effect diffusion of the charge control agent into the particles and is then allowed to cool down to ambient temperature. The treated particles are separated from the reaction mixture by filtration and the entrained solvent in the filter cake is washed off by dispersing the filter cake in isohexane and filtered again. The filtered particles are dried at 40° C. under vacuum for 16 hours. 100 parts by weight of the dry particles are blended with 2 parts by weight of Cab-O-Sil® TG-308F (a fumed silica acting as a flowability improvement aid from Cabot Corporation, Tuscola, Ill.) for 15 minute in a roll mill, whereby a toner No. 1 is obtained according to the present invention. When the particle size was determined, the average particle size is essentially unchanged at 10.4 microns. Scanning electron microscopy examination of the toner particles shows that the particles are spherical with smooth surface texture.

Example 4

Preparation of a Yellow Toner

Into a 250-ml round-bottom flask equipped with a blade-type agitator, 150 parts per weight of Isopar-L®, 25 parts per weight of Genapol® 26-L-1 and 100 parts per weight of the milled particles of Example 2 are charged. The mixture is then heated to 90° C. and maintained at the temperature for 30 minutes under agitation at 100 rpm. 1.5 parts per weight of Zhejiang Cationic Yellow 4GL (a CI Basic Yellow 51 dye from Zhejiang Textiles Corporation, Shanghai, China) is added to the reaction mixture. The dyeing reaction mixture is maintained at the temperature for 60 minutes.

Subsequently, 1.5 parts per weight of Bontron® E-84 (a negative charging charge control agent based on a zinc salt available from Orient Chemical Corporation of America, Springfield, N.J.) is added into the dyeing reaction mixture. The reaction mixture is maintained at 90° C. for additional 30 minutes to effect diffusion of the charge control agent into the particles and is then allowed to cool down to ambient temperature. The treated particles are separated from the reaction mixture by filtration and the entrained solvent in the filter cake is washed off by dispersing the filter cake in isohexane and filtered again. The filtered particles are dried at 40° C. under vacuum for 16 hours.

100 parts by weight of the dry particles are blended with 2 parts by weight of Cab-O-Sil® TG-308F (a fumed silica acting as a flowability improvement aid from Cabot Corporation, Tuscola, Ill.) for 15 minute in a roll mill, whereby a toner No. 2 is obtained according to the present invention. When the particle size was determined, the average particle size is essentially unchanged at 11.0 microns. Scanning electron microscopy examination of the toner particles shows that the particles are spherical with smooth surface texture.

Example 5

Preparation of a Magenta Toner

Into a 250 ml round-bottom flask equipped with a blade-type agitator, 150 parts per weight of Isopar-L®, 25 parts per weight of Genapol® 26-L-1 and 100 parts per weight of the milled particles of Example 2 are charged. The mixture is then heated to 90° C. and maintained at the temperature for 30 minutes under agitation at 100 rpm. 2 parts per weight of Astrazon® Red Violet 3RA (a CI Basic violet 16 dye from Clariant Corporation, Charlotte, N.C.) is added to the reaction mixture. The dyeing reaction mixture is maintained at the temperature for 60 minutes.

Subsequently, 1.5 parts per weight of Bontron® E-84 (a negative charging charge control agent based on a zinc salt available from Orient Chemical Corporation of America, Springfield, N.J.) is added into the dyeing reaction mixture. The reaction mixture is maintained at 90° C. for additional 30 minutes to effect diffusion of the charge control agent into the particles and is then allowed to cool down to ambient temperature. The treated particles are separated from the reaction mixture by filtration and the entrained solvent in the filter cake is washed off by dispersing the filter cake in isohexane and filtered again. The filtered particles are dried at 40° C. under vacuum for 16 hours.

100 parts by weight of the dry particles are blended with 2 parts by weight of Cab-O-Sil® TG-308F (a fumed silica acting as a flowability improvement aid from Cabot Corporation, Tuscola, Ill.) for 15 minute in a roll mill, whereby a toner No. 3 is obtained according to the present invention. When the particle size was determined, the average particle size is essentially unchanged at 10.5 microns. Scanning electron microscopy examination of the toner particles shows that the particles are spherical with smooth surface texture.

Comparative Example 1

Aqueous Dyeing

Into a 500 ml round-bottom flask equipped with a blade-type stirrer, 10 g of the milled polyester particles of Example 2, 200 ml of water and 5 g of Genapol® 26-L-1 are charged at ambient temperature. The mixture is heated to 70° C. over 30 minutes while being agitated at 100 rpm and the temperature was maintained for additional 30 minutes. When a small amount of the reaction mixture is sampled and the particle size determined using a Coulter LS Particle Size Analyzer, the average particle diameter remains essentially unchanged at 11 microns from that of the charged polyester particles. 2 g of Zhejiang Cationic Yellow 4GL is charged into the flask and the mixture is maintained at the temperature for additional 30 minutes. Subsequently, the mixture is cooled down to ambient temperature. The reaction mixture is filtered and the solvent is washed off the particles by dispersing the filter cake in water and filtering. The filtered particles are then dried at 40° C. under vacuum for 16 hours. However, when the particle size was determined, the average particle size was significantly increased to 24 microns. The result points to that an aqueous dyeing of the polyester particles may not be useful as a practical means of producing high-resolution color toner.

Comparative Example 2

Dyeing Particles of a Polyester Resin without Functional Dye Sites 1000 g of Fine Tone® 382-ES resin (a polyester resin for color toners available from Reichhold Chemicals, Research Triangle Park, N.C.) is pulverized and further milled using a ball mill. The resin is a polyester of bisphenol A propoxylate and fumaric acid and does not contain functional sites for dyeing. The resulting particles are then manually classified using a series of sieves to obtain approximately 300 g of milled polyester particles in the size range of 5 microns to 15 microns. The volume average particle size is 10.1 microns with a 10% size of 5.2 microns and a 90% size of 14.1 microns as measured by a Coulter® LS Particle Size Analyzer. Scanning electron microscopy shows that the particles are jagged and irregular.

Into a 250-mi round-bottom flask equipped with a blade-type agitator, 72 g of Isopar-L®, 12 g of Genapol® 26-L-1 and 50 g of the above polyester particles are charged. The mixture is then heated to 90° C. and maintained at the temperature for 30 minutes under agitation at 100 rpm. 0.60 g of Astrazon® Blue BG 200 (a CI Basic Blue 3 dye available from DyStar L.P., Charlotte, N.C.) is added to the reaction mixture. The dyeing reaction mixture is maintained at the temperature for 60 minutes.

Subsequently, 0.75 g of Bontron® E-84 (a negative charging charge control agent based on a zinc salt available from Orient Chemical Corporation of America, Springfield, N.J.) is added into the dyeing reaction mixture. The reaction mixture is maintained at 90° C. for additional 30 minutes to effect diffusion of the charge control agent into the particles and is then allowed to cool down to ambient temperature. The treated particles are separated from the reaction mixture by filtration and the entrained solvent in the filter cake is washed off by dispersing the filter cake in isohexane and filtered again. The filtered particles are dried at 40° C. under vacuum for 16 hours.

100 parts by weight of the dry particles are blended with 2 parts by weight of Cab-O-Sil® TG-308F (a fumed silica acting as a flowability improvement aid from Cabot Corporation, Tuscola, Ill.) for 15 minute in a roll mill, whereby a comparative toner A is obtained. When the particle size was determined, the average particle size is essentially unchanged at 10.7 microns. Scanning electron microscopy examination of the toner particles shows that the particles are spherical with smooth surface texture.

Example 6

Evaluation of Dye Fastness

Approximately 10 $\mu$m thick films of toner No. 1 and comparative toner No. 1 are prepared by mixing each toner sample with a small amount of glass beads with 10 $\mu$m diameter, placing the mixture between two quartz microscope slides, one surface of which is pre-coated with a mold release compound, compression molding a film by compression at 170° C. and 100 psi pressure and, subsequently, removing the top quartz slide. The optical absorption density of the films is determined using a Lambda-19 Spectrophotometer (available from Perkin Elmer Corporation, Norwalk, Conn.).

To assess the dye fastness on exposure to water, one set of the film samples of toner No. 1 and comparative toner No. 1 are immersed in water maintained at 60° C. for 60 minutes and the optical absorption density of the water-treated films is determined. To assess the dye fastness upon exposure to high temperature, another set of the film samples of toner No. 1 and comparative toner No. 1 are placed on a hot plate maintained at 70° C. for 2 hours and the optical density is determined. The results are listed in Table 1.

TABLE 1

| | Optical density ($\mu m^{-1}$) | |
|---|---|---|
| | Toner No. 1 (Example 3) | Comparative Toner A (Comp. Ex. 2) |
| As prepared | 0.23 | 0.05 |
| After thermal exposure | 0.22 | 0.03 |
| After water exposure | 0.23 | 0.02 |

Example 7

Toner Evaluation

The triboelectric charge of the toners described above is determined by a blow-off type electric charge measuring apparatus (Vertex Charge Analyzer supplied by Vertex Image Products, Yukon, Pa.) equipped with a Faraday cage and an electrometer as described below. First, a developer is prepared by blending a toner and a carrier (Type 22 Carrier, copper-zinc ferrite granules coated with a fluoropolymer, supplied by Vertex Image Products) at a ratio of about 2 parts by weight of toner to 100 parts by weight of the carrier. The developer is placed in a glass jar and rolled at 10 rpm for 10 minutes using a roll mill. Approximately 1.5 g of the rolled developer is placed in a Faraday cage and the toner particles are blown out of the Faraday cage using an air stream from a nozzle. The up-stream air pressure is typically about 80 k-newton/$m^2$. Charge induced on the Faraday cage due to blowing-off of charged toner particles for 60 seconds is defined as the toner charge. The charge per unit mass of toner is obtained by dividing the toner charge by the amount of toner blown-off the Faraday cage.

Two different methods are used to assess the optical absorption density of the toners. In the first method, the toner is dissolved in hexafluoroisopropanol at a concentration of 1 g per liter of the solvent and the absorbance of the solution is determined in the double beam configuration using a Lambda-19 spectrophotometer (available from Perkin Elmer Corporation, Norwalk, Conn.). The solution absorbance (A)

is defined as the logarithm of the ratio of intensities of incoming and outgoing optical beams when the path length through the solution is 1 cm.

In the second method, a solid image is printed with a toner using a commercial color laser printer (DocuPrint® C55 available from Xerox Corporation, Rochester, N.Y.) on a polyester transparency film and the optical absorption density of the printed toner film is determined using the Lambda-19 spectrophotometer. The image color density (B) per unit thickness is determined by dividing the optical absorption density by the film thickness. The image density and the solution absorbance are related through the formula;

$$B=A*(\rho*d'/c*d)$$

where c is the toner concentration (in grams per liter) in the solution, d' is the film thickness (in microns), ρ is the density of the toner resin (=1.2 g/cm3) and d is the path length through the solution (in centimeters). Numerically, the formula then becomes, $$B(\mu m^{-1})=0.12*A(cm^{1-1}).$$

The results are shown in the following Table 2.

TABLE 2

| Toner | Charge (μC/g) | Solution absorb. ($cm^{-1}$) | Color | Image color density ($\mu m^{-1}$) |
|---|---|---|---|---|
| No. 1 (Example 3) | −71 | 1.9 | Clear blue | 0.24 |
| No. 2 (Example 4) | −20 | 1.2 | Clear yellow | 0.14 |
| No. 3 (Example 5) | −42 | 1.6 | Clear magenta | 0.18 |
| Comp. A (Comp Ex. 2) | −40 | 0.4 | Clear blue | 0.05 |

The results shown in the above table indicate that the toners according to the present invention provide higher image density than the comparative toner. This is because the resin particles for the toners are dyed to a high dye concentration because of the chemical affinity between the resin containing functionalized sites and the functional dyes. Furthermore, the toners according to the present invention are excellent in light transmittance because the dyes are present in a molecularly dispersed state, so that the toners are suitable for image formation on a transparent substrate to be used with an overhead projector.

The invention has been described in detail in connection with numerous embodiments; however modifications will be readily apparent to those of skill in the art. For example, while the inventive process has been described in connection with a paraffin solvent, other solvents which are stable to the required temperatures may be substituted. Such modifications are within the spirit and scope of the present invention which is set forth in the appended claims.

What is claimed is:

1. A process of preparing a toner for developing latent electrostatic images comprising:

a) dispersing a particulate polyester resin provided with functional sites suitable for interacting with a functionalized dye in a liquid organic medium, said polyester being substantially insoluble in said organic medium;

b) providing said functionalized dye to said organic medium, said functionalized dye having functional sites adapted for interacting with the functional sites on said particulate polyester resin;

c) maintaining the organic medium containing said particulate polyester resin and said dye at an elevated temperature for a time sufficient to dye said resin; and d) separating said organic medium and said particulate polyester resin;

whereby said functionalized dye is applied to said resin particles and the particle size of said particulate polyester resin is substantially unchanged by the aforesaid process.

2. The process according to claim 1, wherein said functional sites of said polyester resin suitable for interacting with a functionalized dye are selected from the group consisting of: hydroxy moieties; alkoxy moieties; sulfonic or derivatized sulfonic moieties; carboxyl or derivatized carboxyl moieties; phosphonic or derivatized phosphonic moieties; phosphinic or derivatized phosphinic moieties; thiol moieties; amine moieties; alkaline moieties; quaternized moieties; and mixtures thereof.

3. The process according to claim 1, wherein said polyester resin is prepared by way of dispersion polymerization.

4. The process according to claim 1, wherein said functionalized dye is an acid dye.

5. The process according to claim 1, further comprising providing a surfactant to said organic medium.

6. The process according to claim 5, wherein said surfactant is a non-ionic surfactant.

7. The process according to claim 6, wherein said non-ionic surfactant contains the residue of an ethylene oxide moiety.

8. The process according to claim 6, wherein said non-ionic surfactant contains the residue of a propylene oxide moiety.

9. The process according to claim 1, wherein said organic medium comprises a non-polar solvent and a surfactant and wherein said surfactant is present in an amount of from about 5 to about 200 percent by weight of the amount of non-polar solvent present.

10. The process according to claim 9, wherein said surfactant is present in an amount of from about 10 to about 50 percent by weight of the amount of non-polar solvent present.

11. The process according to claim 10, wherein said surfactant is present in an amount of from about 20 to about 40 percent by weight of the amount of said non-polar solvent present.

12. The process according to claim 1, further comprising dispersing a charge control agent in said organic medium.

13. The process according to claim 1, wherein said organic medium comprises a non-polar organic solvent.

14. The process according to claim 13, wherein said organic solvent comprises a paraffin.

15. The process according to claim 13, wherein said organic medium further comprises a surfactant.

* * * * *